US005891007A

United States Patent [19]

Bay

[11] Patent Number: 5,891,007

[45] Date of Patent: Apr. 6, 1999

[54] METHOD AND APPARATUS FOR PUNCH-CUTTING NOTCHES IN THE EDGE OF THE BINDING MARGIN OF FOLDED SHEET GOODS

[75] Inventor: Otto Bay, Subingen, Switzerland

[73] Assignee: Christian Bay, Subingen, Switzerland

[21] Appl. No.: 820,643

[22] Filed: Mar. 14, 1997

[30] Foreign Application Priority Data

Mar. 14, 1996 [EP] European Pat. Off. ..... 96810157.6
Apr. 2, 1996 [DE] Germany ..... 286061271

[51] Int. Cl.[6] ..... B31B 1/14

[52] U.S. Cl. ..... 493/358; 493/363; 493/372; 493/417; 493/421; 493/423; 493/458

[58] Field of Search ..... 493/358, 363, 493/372, 352, 357, 417, 421, 423, 441, 458; 281/38; 402/79; 83/40, 682, 683, 917; 270/52.18, 58.07; 283/34, 106, 117

[56] References Cited

U.S. PATENT DOCUMENTS 2,016,052 10/1935 Roeder ..... 493/363
3,274,869 9/1966 Piazze ..... 83/52
3,368,441 2/1968 Piazze ..... 83/588
4,702,135 10/1987 Kwasnitza ..... 493/358
5,045,039 9/1991 Bay .
5,320,340 6/1994 Bay .

FOREIGN PATENT DOCUMENTS 2618257 12/1976 Germany .

*Primary Examiner*—John Sipos
*Assistant Examiner*—Matthew Luby
*Attorney, Agent, or Firm*—W. F. Fasse; W. G. Fasse

[57] ABSTRACT

A method and an apparatus are for forming open-edge V-shaped notches (32) in a binding margin (42) of large-format sheets (11) such as shop drawings or construction plans for example, so that after the sheets have been folded the notches (32) are aligned in registration with binding holes (46) also provided in the binding margin. A cutting and crosswise folding table (20) is provided at the top of a folding machine, and stamping tools (22) are provided at an edge of the table. The large-format sheets are continuously, sequentially output from a device such as a plotter, and fed to the folding machine, where the sheets are folded lengthwise and transported onto the table (20). There, the notches are cut in the binding margin by the stamping tools. The binding holes may be simultaneously formed. Thereafter, a crosswise folding beam (65) folds the sheet in a crosswise direction. The sheets that have been provided with notches and holes, and have been folded in this manner, may be bound in a ring binder in such a manner that the sheet can be completely unfolded without being removed from the binder.

20 Claims, 4 Drawing Sheets

METHOD AND APPARATUS FOR PUNCH-CUTTING NOTCHES IN THE EDGE OF THE BINDING MARGIN OF FOLDED SHEET GOODS

FIELD OF THE INVENTION

The invention relates to a method and an apparatus for punch-cutting notches that are open at the edge of a binding margin of large-format sheet goods, which are especially folded in a zig-zag fashion in lengthwise and crosswise directions, such that the notches provided at one fold ply or section of the binding margin align in registration with binding holes provided at another fold ply or section of the binding margin. The resulting folded sheets can be bound in a ring binder such that the sheets may be unfolded without being removed from the binder.

BACKGROUND INFORMATION

In order to conveniently store and handle large-format sheets of paper, film materials, or the like, such as engineering shop drawings or architectural construction plans or the like, it is generally desired to fold these large sheet goods into a smaller format, preferably a standardized format such as DIN size A4 (297×210 mm) for example. The folded sheets are then provided with binding holes near an edge thereof, so that the folded sheets can be bound in a ring binder. In this context, the sheets must be folded in such a manner that the legend block, or parts list, or other descriptive information typically provided on such drawings appears on the top face or section of the folded sheet when it is arranged in the binder, so that the folded drawing sheet can be conveniently recognized and identified.

Machines and methods for folding such large-format drawings or the like in a zig-zag fashion, and for properly orienting the drawing sheets so that the descriptive legend information appears on the top folded face are already known, for example as disclosed in U.S. Pat. No. 5,045,039 (Bay) and U.S. Pat. No. 5,320,340 (Bay) of the present inventor. The entire disclosures of U.S. Pat. No. 5,045,039 and U.S. Pat. No. 5,320,340 are incorporated herein by reference.

However, it has been difficult in the prior art to provide holes in a binding margin of the folded sheets in such a manner that the sheets can be unfolded while they remain bound in a ring binder. For example, a conventional method involves gluing or otherwise adhering a protruding binding margin onto an edge of the folded sheet, whereby the binding holes could be provided in this added, protruding binding margin. However, such a procedure is inconvenient and involves manual operations that are time-consuming, costly, and prone to inconsistency and misalignments, for adhering the protruding binding margin onto the sheet.

German Patent Publication 2,618,257 discloses a method by which large-format sheet materials are first folded lengthwise in a zig-zag fashion in such a manner that a protruding binding margin remains along the left edge of the lengthwise folded sheet. In other words, the sheet is not uniformly folded edge-to-edge, but rather is folded with an offset so that one edge of the folded sheet protrudes from the other folded plies or sections of the sheet. Next, the sheet is folded one or more times in a crosswise direction, and binding holes are provided only in the lowest fold ply or section of the protruding binding margin. If binding holes are provided in all of the folded layers or sections of the binding margin, then the sheet could not be folded while it remains bound in the ring binder.

However, the plies of the binding margin not having holes therein would tend to interfere with the rings of the binder. Thus, as a next step, notches or cut-outs that are open at the edge of the sheet must be provided along the binding margin in the folded layers above the bottom layer in alignment or registration with the binding holes provided in the bottom layer. These open-edge notches are necessary so that the upper folded layers of the folded sheet do not interfere with the binder rings, and so that the folded sheet can be unfolded without being removed from the binder, while the lowest folded layer remains bound with the binding holes engaged on the binder rings.

The above mentioned open-edge notches have typically in the past been formed in large sheet materials, such as blueprints, or photostat prints, or electrostatic copy prints for example, by manually laying out the sheets in a flat, non-folded condition on a large separate cutting table. On this table, the open-edge notches are cut out, for example by using a rotating circular knife. Thereafter, the sheet was then folded either by hand or by being fed into a folding machine. Such manual operations are relatively slow, labor intensive, and prone to errors, and cause an interruption in the continuous automated production of numerous folded large-format sheets, i.e. the manual operation forms a bottle-neck between a plotter or copying machine which outputs the sheets, and the folding machine. In systems in which large-format drawings or the like are continuously output by a plotter or other image producing apparatus, and then the flat sheets are fed directly to an adjacent or connected folding machine, it is no longer possible to carry out a manual operation for providing the open-edge notches in the typical manner.

OBJECTS OF THE INVENTION

In view of the above it is the aim of the invention to achieve the following objects singly or in combination:

- to mechanically form, e.g. cut out, open-edge notches at predetermined locations along a binding margin of a sheet material that is to be folded;
- to provide a notch-forming apparatus that can be used in connection with and interposed between a plotter or printer or the like and a folding machine arranged at the output thereof, such that the open-edge notches can be provided without disrupting or interrupting the continuous sheet output of the plotter or the like, or the continuous multiple folding of the sheet being carried out by a folding machine arranged directly at the output of the plotter;
- to provide a compact arrangement of such an apparatus that can be incorporated into a folding machine without requiring substantial additional space;
- to avoid manual operations such that the entire sequence of steps for providing holes and notches in the binding margin of the sheets can be automatically mechanically carried out; and
- to improve the accuracy, reproducibility, and adjustability of providing the required open-edge notches in folded sheet materials.

SUMMARY OF THE INVENTION

To achieve the above objects, the invention provides an apparatus for cutting out open-edge notches in a lateral binding margin of large-format sheets that are to be folded in a zig-zag fashion such that the notches are located in registration with binding holes provided at other locations in the binding margin. The apparatus according to the invention especially includes at least two punching or stamping tools arranged on a table at the top of a folding machine. The stamping or punching tools respectively include cutting stamps that are driven by a common drive shaft. The apparatus further includes at least one sheet transport device that moves the sheet across the table in a first motion direction perpendicular to the lengthwise extension direction of the binding margin, toward and into a position for cooperation with the punching or stamping tools. The apparatus further includes a switching device and a stop surface arranged so that when the sheet is transported into a position against the stop surface, the switching device triggers the stamp-cutting process to be carried out by the stamping tools.

The invention further provides a method of stamp-cutting open-edge notches in a lateral binding margin of large-format foldable sheets, wherein the notches are mechanically formed in the binding margin of a partially folded sheet between a lengthwise folding step and a crosswise folding step in a folding machine. The notch cutting step is preferably carried out on a table at the top side of the folding machine.

By providing punching or stamping tools directly on a table at the top side of the folding machine, it is possible to automatically cut the open-edge notches in the binding margin of the sheet directly on the table in the folding machine, and particularly between the lengthwise folding and the crosswise folding of the sheet. As a result, it is possible to carry out the notch-cutting operation within the operating rhythm or cycle of the folding machine, especially in connection with the output of the plotter or printer. In this manner, the open-edge notches can be formed without interrupting the mechanical folding process and while avoiding the need of any manual operations.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
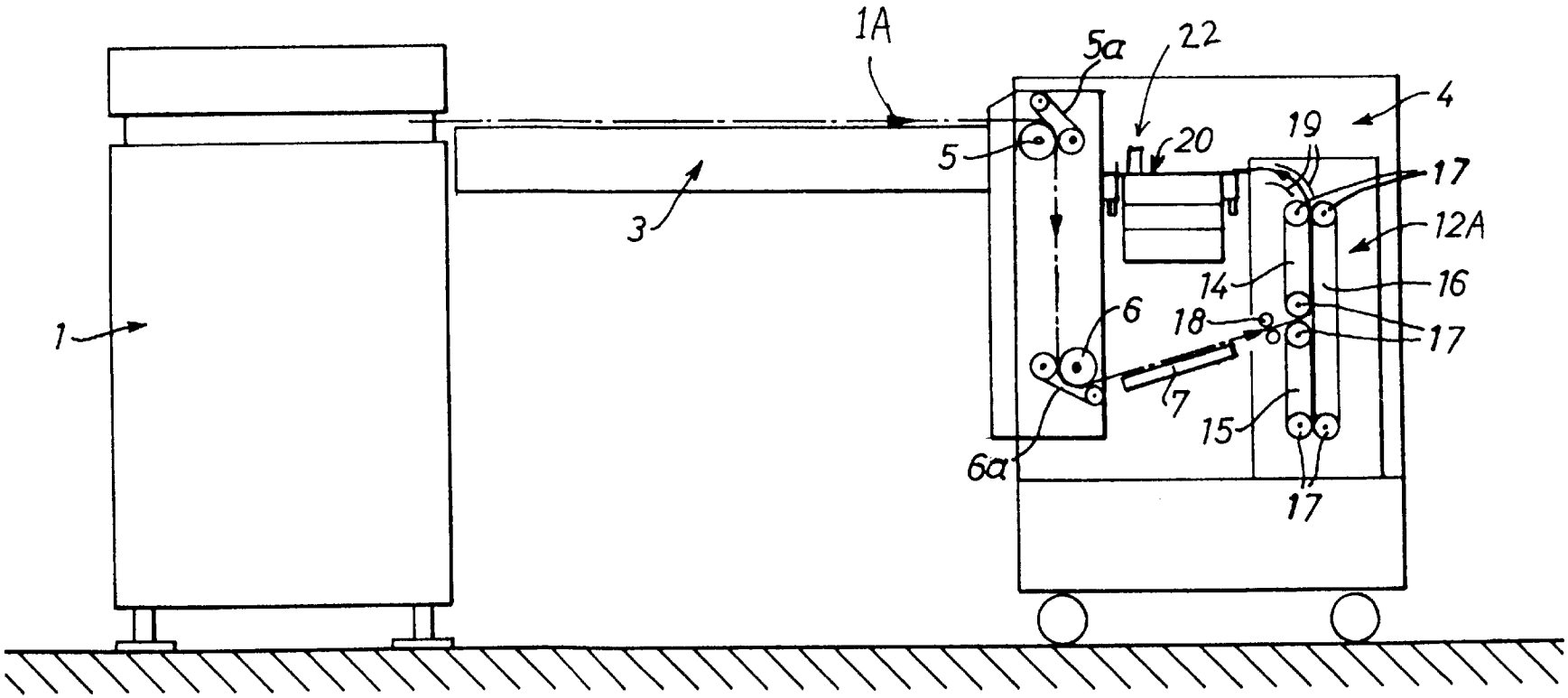
FIG. 1 is a schematic general side view of a plotter and a folding machine connected to the output of the plotter, wherein the folding machine is equipped with a notch cutting apparatus according to the invention.

FIG. 1 shows a device such as a xerographic copying machine or a typical commercial plotter 1 or the like for producing large-format drawings, such as shop drawings or architectural structural plans in particular. The plotter 1 or other output apparatus continually produces and outputs individual separated flat sheets as shown by arrow 1A, onto a plate-like transfer bridge or conveyor 3, which transports the sheets by rollers or transport belts, and feeds the sheets into a folding machine 4. Such a folding machine 4 may, for example, be according to the disclosure of U.S. Pat. No. 5,045,039 (Bay). Furthermore, the transfer bridge equipment 3 may include a sheet turning and positioning apparatus, for example according to the disclosure of U.S. Pat. No. 5,320,340 (Bay).

In the folding machine 4, the incoming sheets are deflected around a first deflection roller 5 that cooperates with a deflection belt 5A, to direct the sheet generally downward toward and around a second deflection roller 6 cooperating with a deflection belt 6A, so as to direct the sheet onto a stationary table 7. From the table 7, the sheet is transported by two transport rollers 18 into a lengthwise folding device 12A. This lengthwise folding device 12A includes two first folding belts 14 and 15 arranged vertically one above the other with a paper intake gap therebetween. A longer third folding belt 16 is arranged parallel to and adjacent the two first folding belts 14 and 15. The three folding belts 14, 15, and 16 are respectively supported on and guided around respective upper and lower deflection rollers 17, which are motor driven. The transport rollers 18 pull the sheet from the table 7 between the rollers 18 and feed it into the gap between the two first folding belts 14 and 15. The folding belts 14, 15, and 16 are then operated in such a manner so as to fold the sheet in a zig-zag manner along the lengthwise fold lines 12 (see FIG. 4). This is achieved by a predetermined controlled activation of the folding belts 14, 15, and 16 in forward and reverse motion directions, as is described in detail in U.S. Pat. No. 5,045,039.

After the lengthwise folding operation, the lengthwise-folded sheet exits the lengthwise folding device 12A and is directed by deflection guides 19 to turn from the output at the top of the lengthwise folding device 12A onto a horizontal support and cutting table 20 arranged above the folding belts 14, 15, and 16 at the top of the folding machine 4. At least two punching or stamping tools 22 are arranged on top of this table 20, as shown particularly in FIGS. 2 and 3. The lateral center spacing of the two stamping tools 22 from each other is adjustable in any known manner, and is set to correspond to the ring spacing of the ring binder mechanism. For example, this spacing is 8 cm for a typical binder, so that the hole spacing and the notch spacing must also be 8 cm. Although FIGS. 3 and 4 show an example arrangement of two stamping tools 22 to provide two cut-out notches 32 coinciding with two binder ring engagement holes 46, it is alternatively possible to provide three or four stamping tools 22 when three or four binder ring holes 46 are to be provided.

Figure 2:
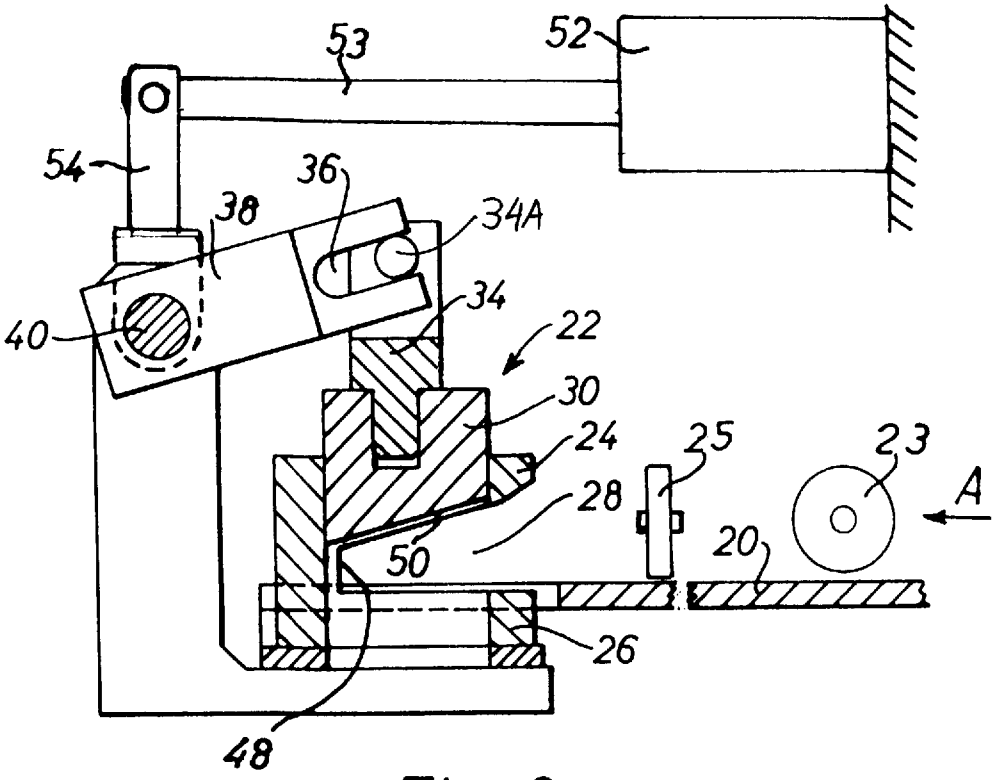
FIG. 2 is a sectional view through a punching or stamping tool of the notch cutting apparatus according to the invention, on an enlarged scale relative to FIG. 1.
Figure 3:
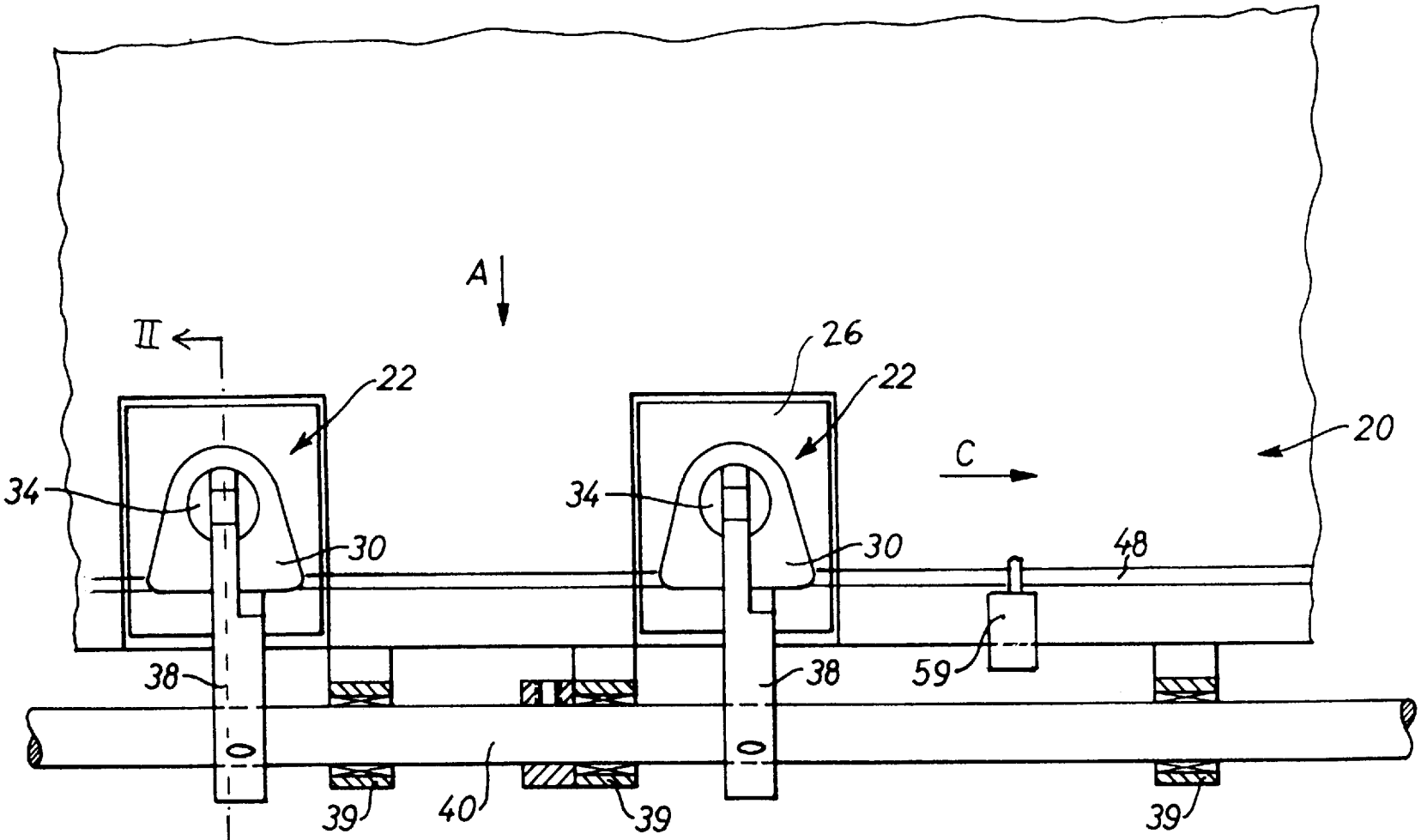
FIG. 3 is a top view showing two stamping tools arranged in the cutting table, and showing a section line II—II for FIG. 2.
Figure 4:
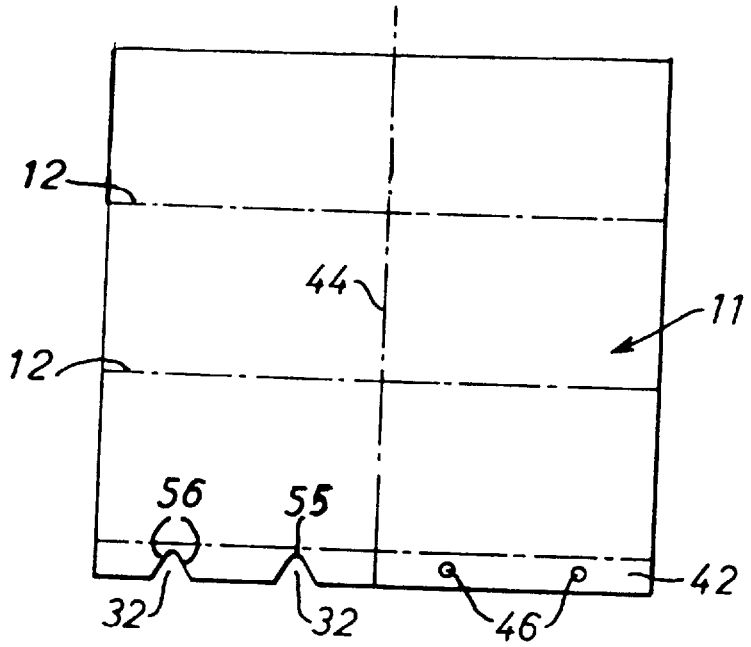
FIG. 4 is a schematic plan view of a flat foldable sheet in its unfolded condition, showing the lengthwise and crosswise fold locations by dashed lines, and showing open-edge notches and binding holes provided in the binding margin of the sheet.

Referring especially to FIGS. 2 and 3, each stamping tool 22 comprises a cutting stamp 30 that is vertically movably guided in a guide member 24 and cooperates with a die 26, for forming the open-edge notches 32 in the binding margin 42 of the material sheet. In the illustrated example, the cutting stamp 30 has a contour as shown especially in FIG. 3, in order to produce the U- or V-shaped cut-out notch 32 in the binding margin 42 as shown in FIG. 4. More specifically, the notches 32 preferably have a contour including a rounded portion 55 and two substantially linear side boundaries 56 adjoining the rounded portion 55 and forming an acute angle relative to one another. While this is the preferred notch shape for resisting tearing of the sheet binding margin for example, other shapes could be used, for which the stamp 30 and die 26 would simply be exchanged with correspondingly shaped members. The die 26 preferably consists of a single piece of hardened steel, which is for example set into an opening or recess in the table 20.

As shown in FIG. 2, each stamping tool 22 is arranged to form a V-shaped sheet receiving throat 28, having a lower edge flush with the surface of table 20, and an upper edge that slants upward to open toward and receive the binding margin of the lengthwise folded sheet 11 in which the open-edge notches 32 are to be formed. The upper edge of the throat 28 is formed by a cutting edge 50 of the respective cutting stamp 30. The back of the throat 28, i.e. the connection between the upper edge and the lower edge of the throat 28, is formed by a stop edge or stop surface 48. The cutting edge 50 extends at an angle relative to the surface of the cutting table 20, whereby the lowest point of the cutting edge 50 is located on the side of a stop surface 48 forming the back of the sheet receiving throat 28. By using such a tilted or angled cutting edge 50, a scissors-like cutting process is achieved, which requires a lower application of force and achieves a cleaner cut than the case of using a horizontal cutting edge on the cutting stamp.

Each cutting stamp 30 is driven by a linkage as follows. As shown in FIG. 2, a connecting member 34 is seated in the top of each cutting stamp 30, and in turn is connected to a forked or slotted rocker arm 38. More specifically, a pin 34A extending between two upright fork portions of the connecting member 34 is received in a slot 36 of the rocker arm 38. The plural rocker arms 38 connected to the plural stamping tools 22 are rotationally fixedly connected to a single rocking drive shaft 40 that is common to all of the rocker arms 38. The rocking drive shaft 40 is rotatably supported in rotational bearings 39. An electromagnet 52 is connected to a drive rod 53 so as to drive the rod 53 in an axial direction. The drive rod 53 in turn is pivotally connected to a drive link or drive lever 54 that is fixedly connected to the rocking drive shaft 40, to couple the drive rod 53 at a radial offset with the drive shaft 40. Thus, the actuation of the electromagnet 52 rocks the drive shaft 40 and the rocker arms 38, so as to drive the cutting stamps 30 of the stamping tools 22 in an up and down direction. A return stroke can be actuated by return springs which are not shown.

In order to provide the binding holes 46 in the binding margin 42, i.e. the holes 46 that will be mounted on the rings of the ring binder, the present apparatus may also include hole punching tools 22A respectively arranged symmetrically to the stamping tools 22 about the crosswise fold line 44 of the folded sheet 11. Preferably, the hole punch tools 22A can be embodied similarly to the stamping tools 22, but with a round hole punch rather than an edge-notch cutting stamp 30. Furthermore, the hole punches 22A may be connected to and driven by the common rocking drive shaft 40 by respective linkages similar to that described above in connection with the stamping tools 22. Alternatively, the present apparatus may omit hole punches 22A, and the holes 46 can be formed at a different location, i.e. other than on the cutting table 20, either before or after the folding process, for example using any hole punch tool that is known per se. After the notches 32 have been provided, it is a simple matter to punch the holes 46 even after the sheet 11 has been completely folded, because the overlapping portions of the binding margin 42 do not present any obstruction to the hole punching operation.

The apparatus operates as follows to form the open-edge cut-out notches 32. First, the lengthwise folded sheet 11 is transported onto the folding table 20 from the folding belts 14 and 16 via the deflection guide 19 as described above. Then, sheet transport devices, such as preferably sheet transport rollers 23, transport the lengthwise folded sheet 11 on the table 20 in the direction of arrow A into the sheet receiving throat 28 of the stamping tools 22 until the sheet edge comes to rest against the stop surface 48. A switching device 59 such as a feeler micro-switch 59 or a light beam switch is arranged adjacent the stop surface 48 to detect the arrival of the edge of the sheet 11. Thus, as soon as the binding margin 42 of the folded sheet 11 reaches and rests against the stop surface 48, the switching device 59 triggers the notch stamping process. Namely, the electromagnet 52 is switched on, so that the drive rod 53 is pulled so as to rock the drive lever 54, the rocking shaft 40, and the rocker arms 38, so as to drive the connecting members 34 and the cutting stamps 30 in a downward direction.

Figure 5:
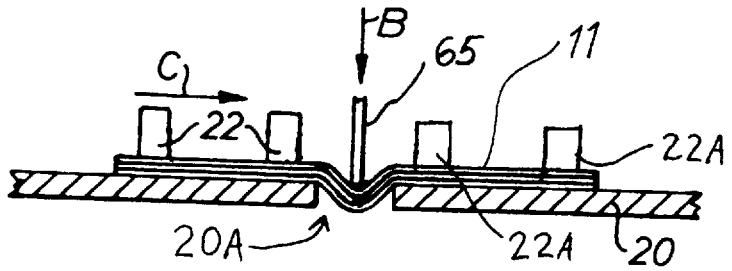
FIG. 5 is a cross-sectional view through a partially folded sheet that has previously been folded lengthwise and is now at the beginning of the crosswise folding process carried out by a crosswise folding arrangement.

After the cutting stamps 30 have completed the downward stroke, and thus completed the stamp cutting of the notches 32, the cutting stamps 30, and the entire drive linkage, are again pulled back or upward into the starting position by return springs, which are not shown. Following this, with a very minimal time delay, a crosswise folding blade or beam 65 carries out its folding operation. As shown in FIG. 5, the crosswise folding beam 65 is arranged laterally next to the stamping tools 22 above a folding gap 20A in the table 20. To carry out the crosswise or transverse folding operation of the sheet 11 along the fold line 44, the crosswise folding beam 65 is driven downward in the direction of arrow B (see FIG. 5), preferably by a mechanical-electrical drive linkage. In this manner, the sheet 11 that is lying on the table 20 and that has previously already been folded in the lengthwise direction, is now folded along the crosswise fold line 44, to produce a finished end product, namely a sheet that has been folded in the lengthwise and crosswise directions and that has been provided with notches 32 and holes 46 in the binding margin 42 thereof. The specific arrangement of the folding beam 65 may also be as disclosed in U.S. Pat. No. 5,045,039, for example. As further disclosed therein, folding rollers may be arranged under the gap 20A in the table to carry out the crosswise folding in cooperation with the blade or beam 65, and to further transport the folded product if necessary.

Due to the downward motion of the folding beam 65, the folded sheet 11 is pulled in the direction of arrow C parallel to the stop surface 48 along the table 20, so that the sheet 11 is pulled clear of the sheet receiving throats 28 of the stamping tools 22 and pushed downward through the folding gap 20A. In this manner, the finished folded product may be delivered into an output bin or chute, for example, without requiring any additional transport devices for the folded sheet. However, in case the crosswise folding device is located laterally further away from the stamping tools 22, or if a different type of crosswise folding device is to be used, then transport rollers 25 (see FIG. 2) can be provided to drive the partially folded sheet 11 in the direction of arrow C parallel to the stop surface 48 after the completion of the stamp-cutting of the V-shaped notches 32.

Since the notch cutting operation is performed between the lengthwise and crosswise folding operations, the sheet is in a relatively compact partially folded condition when the notch-cutting is carried out. Therefore, the present apparatus can be quite compact, and can be incorporated directly into the folding machine without requiring substantially more space.

After the crosswise folding operation, the sheet 11 has been folded in such a manner that the open-edge notches 32 and the holes 46 provided in the binding margin 42 are respectively aligned or registered with one another, namely the notches 32 respectively overlap the locations of the holes 46. The lengthwise folds 12 are carried out and positioned in such a manner that the folded sheet portions do not extend over the binding margin 42, namely the binding margin 42 protrudes from the edge of the sheet portions that have been folded onto one another. Thus, the holes 46 can be mounted on the rings of a ring binder, and the portion of the folded sheet 11 provided with open-edge notches 32 can be flapped out of the binder and the sheet can be unfolded without being removed from the binder. For example, it can be desirable to be able to unfold the sheet without removing it from the binder if the binder mechanism has been locked or secured against unauthorized opening in order to prevent removal of shop drawings or construction plans or the like.

Although the invention has been described with reference to specific example embodiments, it will be appreciated that it is intended to cover all modifications and equivalents within the scope of the appended claims. It should also be understood that the present invention extends to embodiments including all possible combinations of the features recited in various ones of the following appended claims.

What is claimed is:

1. An apparatus for forming open-edge notches in a binding margin of a large-format sheet of material that is to be folded along a crosswise fold line location such that after said sheet is in a completely folded condition said notches are in overlapping registration with binding holes that have also been provided at hole locations in said binding margin of said sheet, said apparatus comprising a support table arranged to supportingly receive said sheet thereon, a plurality of stamping tools arranged on said table and including respective cutting stamps adapted to cut said notches at notch locations in said binding margin of said sheet, such that said notch locations are symmetrical to said hole locations relative to said fold line location a common drive shaft operatively connected to each of said stamping tools to drive said stamping tools, a first sheet transport device arranged on said table to transport said sheet on said table in a first transport direction toward said stamping tools and perpendicular to a lengthwise extension direction of said binding margin of said sheet, a stop surface arranged at said stamping tools, and a switching device arranged on said table to sense when said binding margin of said sheet is in a stamping position against said stop surface and to then trigger actuation of said drive shaft.

2. The apparatus according to claim 1, further in combination with a sheet folding machine for folding said sheet in lengthwise and crosswise directions, wherein said support table of said apparatus is arranged substantially horizontally at a top of said folding machine.

3. The apparatus in combination with the sheet folding machine according to claim 2, wherein said sheet folding machine includes a lengthwise folding device arranged and adapted to fold said sheet from an unfolded condition into a lengthwise folded condition along at least one lengthwise fold line extending in a lengthwise direction of said sheet, and a crosswise folding device adapted to fold said sheet from said lengthwise folded condition into said completely folded condition along at least one crosswise fold line extending in a crosswise direction of said sheet, wherein said support table is interposed between said lengthwise folding device and said crosswise folding device in a transport path of said sheet.

4. The apparatus according to claim 1, further comprising a folding blade movably arranged on said support table to extend in a plane substantially parallel to said first transport direction at a position laterally offset from said stamping tools.

5. The apparatus according to claim 4, wherein said support table has a folding gap therein extending below and aligned with said folding blade, wherein said folding blade is vertically movable from a first position above said table to a second position extending into said folding gap so as to fold said sheet and simultaneously pull said sheet away from said stamping tools in a second transport direction substantially perpendicular to said first transport direction and substantially parallel to said lengthwise extension direction of said binding margin of said sheet.

6. The apparatus according to claim 4, wherein each said stamping tool further comprises a die arranged to cooperate with said cutting stamp for carrying out a notch cutting operation, and further comprising a plurality of rocker arms respectively interposed and connected between each said stamping tool and said common drive shaft to provide said operative connection therebetween, and an electromagnet connected to said common drive shaft to rockingly drive said drive shaft.

7. The apparatus according to claim 4, further comprising a plurality of hole punches that are adapted to punch said binding holes in said binding margin of said sheet and that are arranged on said support table substantially in a line with said stamping tools and respectively laterally offset from said stamping tools symmetrically about said plane of said folding blade.

8. The apparatus according to claim 7, wherein said hole punches are operatively connected to said common drive shaft to be driven thereby.

9. The apparatus according to claim 1, further comprising a plurality of hole punches that are adapted to punch said binding holes in said binding margin of said sheet and that are arranged on said support table substantially in a line with said stamping tools and respectively laterally offset from said stamping tools symmetrically about a symmetry plane extending substantially parallel to said first transport direction at a position between said stamping tools and said hole punches.

10. The apparatus according to claim 1, further comprising a second sheet transport device arranged on said table to transport said sheet on said table in a second transport direction substantially perpendicular to said first transport direction and substantially parallel to said lengthwise extension direction of said binding margin of said sheet.

11. The apparatus according to claim 1, wherein each said stamping tool further comprises a die arranged to cooperate with said cutting stamp for carrying out a notch cutting operation, and further comprising a plurality of rocker arms respectively interposed and connected between each said stamping tool and said common drive shaft to provide said operative connection therebetween, and an electromagnet connected to said common drive shaft to rockingly drive said drive shaft.

12. The apparatus according to claim 1, wherein each one of said cutting stamps has a respective cutting edge that extends at an angle relative to a plane in which said support table extends to form an open sheet receiving throat in each respective one of said stamping tools, wherein said stop surface is arranged forming a back of said throat in each respective stamping tool, and wherein a part of each said respective cutting edge closest to said plane of said support table is at a side of said cutting edge adjacent said stop surface.

13. The apparatus according to claim 1, wherein each one of said cutting stamps has a respective cutting edge having a plan shape including two straight side edges extending at an acute angle relative to each other and a curved edge connecting proximal ends of said straight side edges together.

14. A method for mechanically folding a large-format sheet of material and providing open-edge notches in a binding margin of said sheet, wherein said binding margin also has binding holes therein, said method comprising the following steps in order:

(a) mechanically folding said sheet from an unfolded condition into a lengthwise folded condition along at least one lengthwise fold line extending in a lengthwise direction of said sheet;

(b) mechanically cutting said open-edge notches in said binding margin of said sheet in said lengthwise folded condition; and (c) mechanically folding said sheet from said lengthwise folded condition into a completely folded condition along at least one crosswise fold line extending in a crosswise direction of said sheet;

wherein said step (b) comprises cutting said notches at such locations relative to said crosswise fold line of said step (c) so that said notches are positioned respectively in overlapping registration with said binder holes when said sheet is in said completely folded condition after said step (c).

15. The method according to claim 14, wherein said step (a) is carried out in such a manner so that said binding margin protrudes laterally from overlapping folded sections of said sheet in said lengthwise folded condition.

16. The method according to claim 14, further comprising a step of mechanically punching said binding holes into said binding margin of said sheet in said lengthwise folded condition.

17. The method according to claim 16, wherein said step of mechanically punching said binding holes is carried out simultaneously with said step (b).

18. The method according to claim 17, wherein said steps (a), (b) and (c) are carried out in immediate succession of one another without interruption.

19. The method according to claim 14, wherein said steps (a), (b) and (c) are carried out in immediate succession of one another without interruption.

20. The method according to claim 14, expressly excluding any manual operations during and between said steps (a), (b) and (c).

* * * * *

UNITED STATES PATENT AND TRADEMARK OFFICE

CERTIFICATE OF CORRECTION

PATENT NO. : 5,891,007

DATED : Apr. 6, 1999

INVENTOR(S) : Bay

It is certified that error appears in the above-identified patent and that said Letters Patent is hereby corrected as shown below:

On the Title Page, under [30] Foreign Application Priority Data, line 2, replace "286061271" by --296 06 127.1--.

Col. 7, line 34, after "location" insert --,--.

Signed and Sealed this

Twenty-seventh Day of July, 1999

*Attest:*

*Attesting Officer*

Q. TODD DICKINSON

*Acting Commissioner of Patents and Trademarks*